US005906130A

United States Patent [19]

Sekera et al.

[11] Patent Number: 5,906,130

[45] Date of Patent: May 25, 1999

[54] QUICK CHANGE PILGER DIE AND ASSEMBLY OF SAME WITH ROLLSTAND ARBOR

[75] Inventors: Keith Robert Sekera, Penn Township; Albert Bruce Cady, Pittsburgh; James Edward Buzcak, Slickville, all of Pa.

[73] Assignee: CBS Corporation, Pittsburgh, Pa.

[21] Appl. No.: 09/111,050

[22] Filed: Jul. 7, 1998

[51] Int. Cl.[6] ..... B21B 39/20

[52] U.S. Cl. ..... 72/252.5

[58] Field of Search ..... 72/208, 209, 214, 72/252.5; 492/1, 30, 45; 403/381, 383

[56] References Cited

U.S. PATENT DOCUMENTS

| | | | |
|---|---|---|---|
| 3,600,913 | 8/1971 | Dorp | 72/220 |
| 3,688,643 | 9/1972 | Prieur et al. | 90/24.3 |
| 4,674,312 | 6/1987 | Cook | 72/208 |
| 4,819,471 | 4/1989 | Cook | 72/214 |
| 4,866,968 | 9/1989 | Cellier et al. | 72/208 |
| 5,418,456 | 5/1995 | Cook et al. | 324/207.23 |

*Primary Examiner*—Joseph J. Hail, III
*Assistant Examiner*—Rodney A. Butler

[57] ABSTRACT

A pilger die assembly in which the die has an annular body with an opening extending from a central, through bore to the peripheral surface. The opening subtends a circumferential angle at the through bore of less than 180°. The cylindrical arbor has a section of reduced cross-sectional dimension, preferably formed by a flat. The die is positioned with the opening aligned with the flat, slid into coaxial registration with the arbor, rotated to a captured position in which the opening is no longer aligned with flat on the arbor and then pushed axially to engage a key on the arbor in a keyway extending axially from one side face of the die. A stop screw threaded into the arbor adjacent the other side face of the die locks it in place.

15 Claims, 4 Drawing Sheets

QUICK CHANGE PILGER DIE AND ASSEMBLY OF SAME WITH ROLLSTAND ARBOR

BACKGROUND OF THE INVENTION

1. Field of the Invention

This invention relates to apparatus for cold forming metals, and particularly to pilgering apparatus for reducing the cross-section of tubing such as zirconium alloy tubing used in making fuel rods for nuclear power plants.

2. Background Information

A pilger mill is a forming apparatus for axially elongating and reducing the diameter of a ductile tube. A pair of opposed rollers or dies having tapered grooves around a portion of their circumference bear on the tube which is supported on a mandrel. The dies reduce the external diameter while the mandrel prevents the tube from collapsing under the force of the roller dies and dictates the inner diameter of the tube. The dies are operated in a cyclic manner to incrementally cold work the tube. With each stroke, the tube is advanced along its longitudinal axis and rotated.

Pilger forming is used in the production of precision tubing such as zirconium alloy tubes used in cladding nuclear fuel. The machine operates at up to about 250 work and return stroke cycles per minute.

Conventionally, the dies are ring shaped and are heat shrunk onto a shaft or arbor which is journalled at both ends and geared for coordinated rotation. Typically, the annular die is provided with a keyway engaged by a key on the shaft or arbor for synchronization of the timing of the confronting die pair.

Changing of such a conventional pilger die requires removal of the die and arbor weighing several hundred pounds from the pilger machine using a crane. The spent die must then be heated to remove it from the shaft before a new die can be heat shrunk in its place. This is a time consuming practice averaging well above three hours.

An attempt was made to reduce the change out time for pilger dies by using a die with a horseshoe shaped opening which allowed it to be laterally slid on and off the arbor. The die was fixed in place on the arbor by axial clamping members. This procedure eliminated the need to heat shrink the die onto the arbor and to remove the arbor from the pilger machine saddle, resulting in a very substantial reduction in the time required. However, the reciprocation of the arbors and dies at 250 or more cycles per minute generated forces which made it difficult to maintain the die on the arbor.

SUMMARY OF THE INVENTION

The present invention is directed to a quick change pilger die assembly in which the die has an annular body with a central through bore and a peripheral surface with a circumferentially extending die groove therein. An opening extends all the way through the annular body from the through bore to the peripheral surface and subtends a first circumferential angle at the through bore of less than 180°. The cylindrical arbor has a section with a reduced cross-sectional dimension which is sized to allow the die, through alignment of the opening with the section of reduced cross-sectional dimension, to pass into coaxial registration with the arbor. The die is then moved on the arbor to a captured position with the opening in the die out of alignment with the section of reduced cross-sectional dimension of the arbor. Locking means retains the die in the captured position on the arbor.

With this assembly, the die can be quickly and easily mounted on or removed from the arbor without the need for heat shrinking or expansion. Thus, the die can be mounted on the arbor while the latter remains in the pilger machine. It also overcomes the problem of maintaining the die on the arbor as the opening of less than 180° allows the die to be positioned on the arbor after it is slid on through alignment with the reduced cross-sectional dimension of the arbor to a position where it is captured by the arbor.

Preferably, the section of reduced dimension on the arbor is a transverse flat. This allows the die to be rotated to the captured position.

The locking means includes a keyway in either the die or the arbor and a key fixed to the other which is received in the keyway to prevent rotation of the die on the arbor. Preferably, the keyway is formed in the die and extends from a first side face of the die and axially along the through bore while the key is fixed to the arbor. The locking means can also include a stop secured to the arbor which bears against a second side face of the die with the keyway engaged with the key. In the disclosed embodiment of the invention, the key fixed to the arbor axially overlaps but is positioned circumferentially away from the die as the die is passed over the section with the flat. In this instance, the die has a recess in the first side surface accommodating the key for rotation of the die on the arbor to align the keyway with the key for axial engagement of the keyway with the key.

The opening in the annular body subtends a second circumferential angle at the peripheral surface which is angularly smaller than the first circumferential angle at the through bore. Preferably, the opening is wider at the peripheral surface than at the through bore. This provides a lead angle for engaging the die with the flat on the arbor during installation.

The invention also is directed to the die as described above in addition to its assembly with the arbor.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

Figure 1:
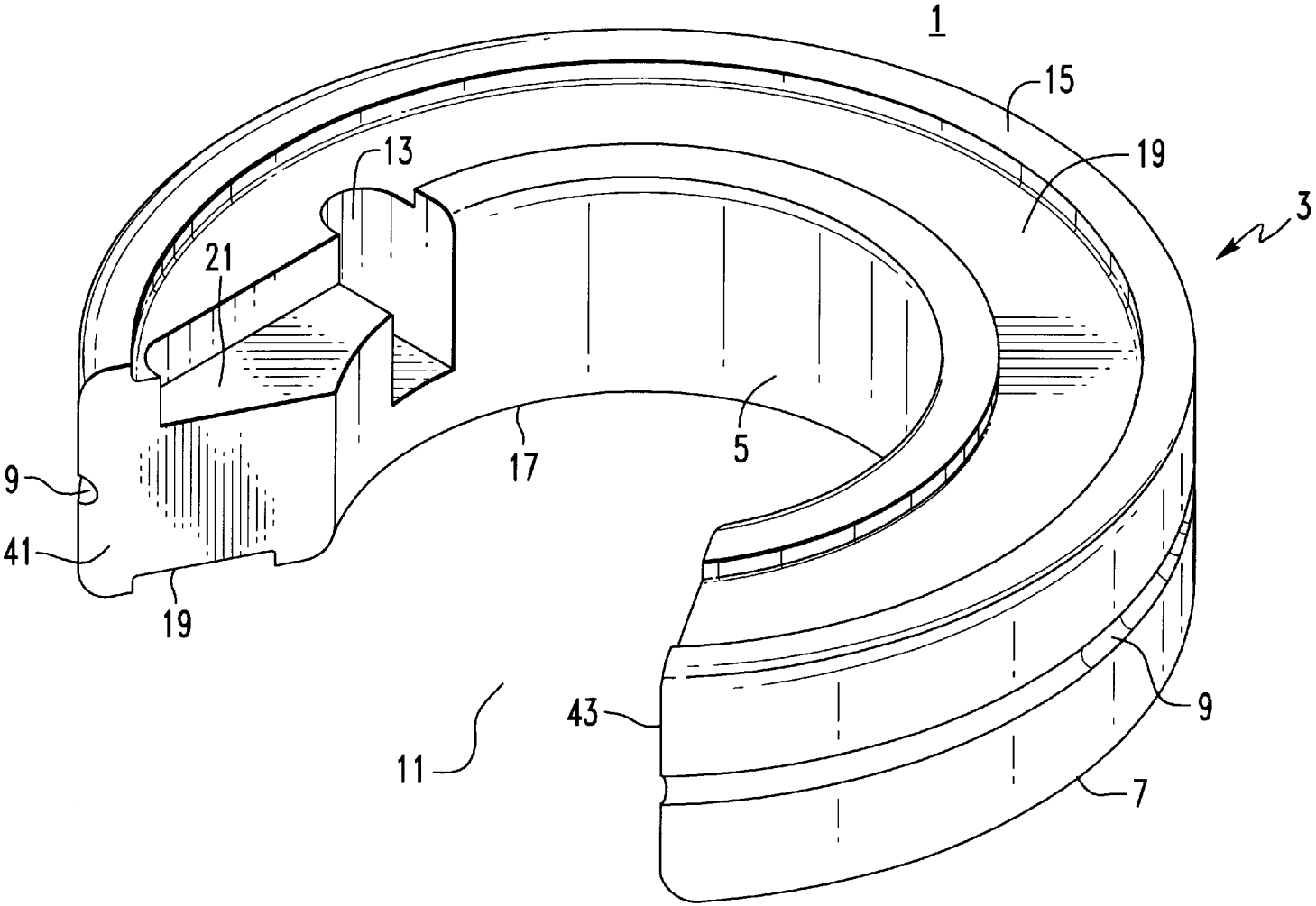
FIG. 1 is an isometric view of a pilger die in accordance with the invention.
Figure 3:
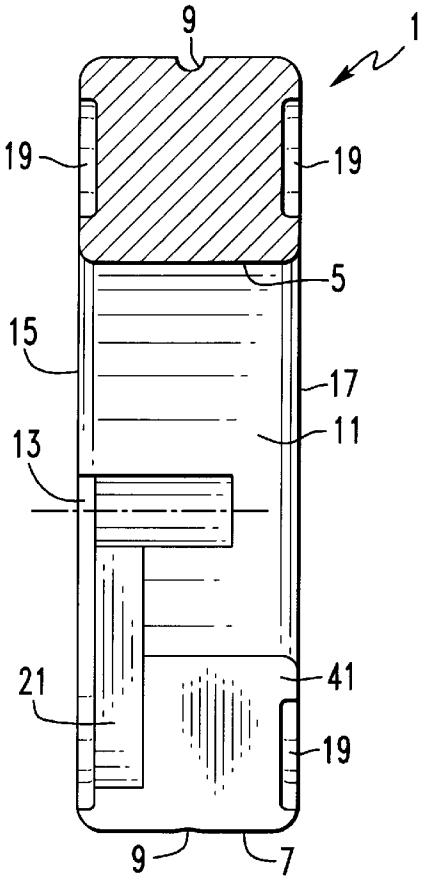
FIG. 3 is a section through the die taken along the line 3—3 in FIG. 2.
Figure 2:
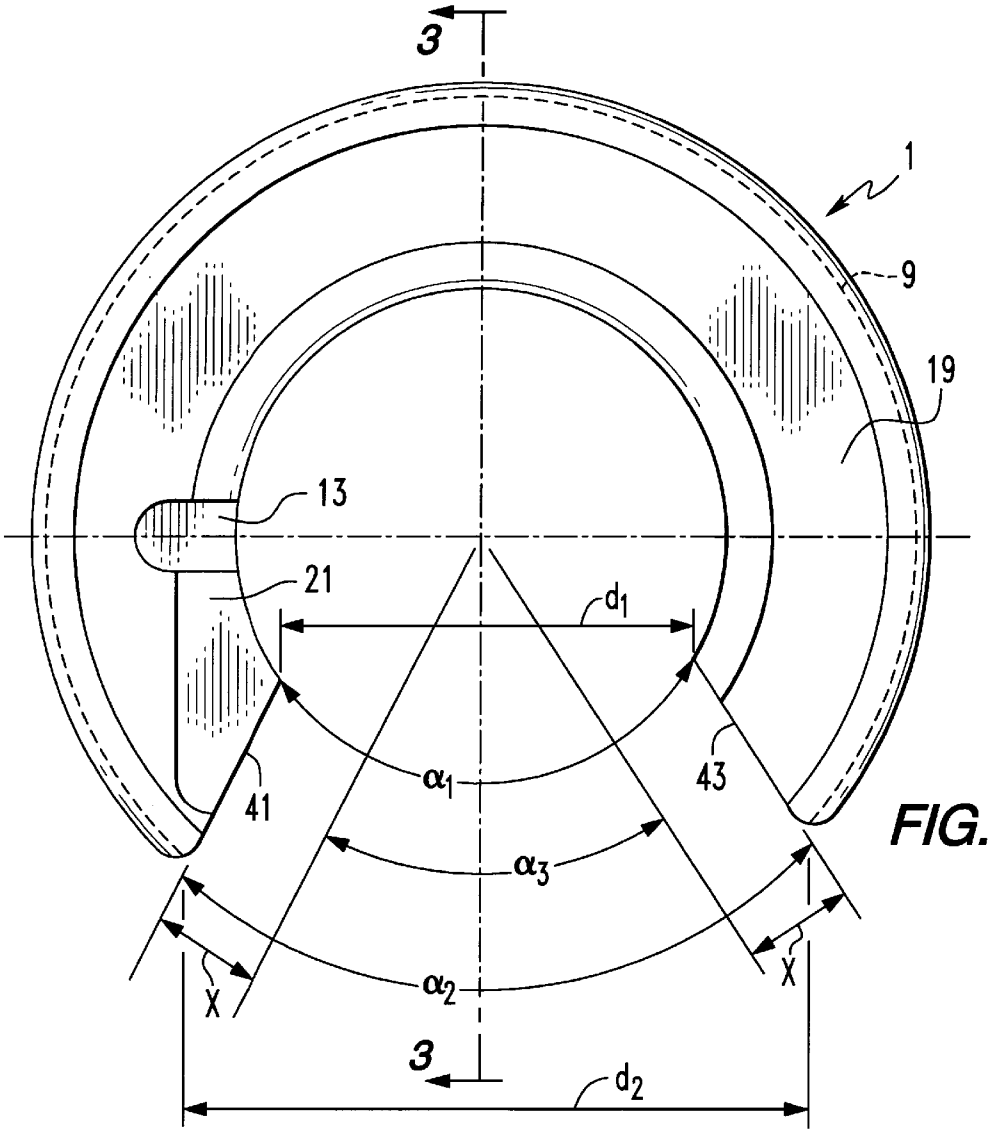
FIG. 2 is a plane view of the die of FIG. 1.

Referring to FIGS. 1–3, the pilger die 1 in accordance with the invention has an annular body 3 with a central through bore 5. The peripheral surface 7 of the annular body 3 has a circumferentially extending semi-circular, tapered die groove 9. The annular body 3 also has an opening 11 extending through the annular body from the through bore 5 through the peripheral surface 7. This opening 11 subtends a first circumferential angle, $\alpha_1$, at the through bore 5, and a second circumferential angle, $\alpha_2$, at the peripheral surface. The angle $\alpha_1$ is less than 180° for a purpose which will become apparent. The second circumferential angle $\alpha_2$ is preferably angularly smaller than the first circumferential angle $\alpha_1$. However, as can be seen from FIG. 2, the opening 11 is wider, as measured by $d_2$ at the peripheral surface 7 than at the through bore 5 as indicated by the distance $d_1$. The reason for this preferred arrangement will be discussed in connection with the mounting of the pilger die 1 on an arbor.

The pilger die 1 has a keyway 13 which extends radially outward from the through bore 5 and axially along the through bore from a first side face 15. Both the first side face 15 and the second side face 17 of the annular body 3 have annular recesses 19 which reduce the overall weight of the die and provide a hand grip. In addition, the first side face 15 has a groove 21 which leads from the opening 11 to the keyway 13, again, for a purpose to be discussed.

Figure 4:
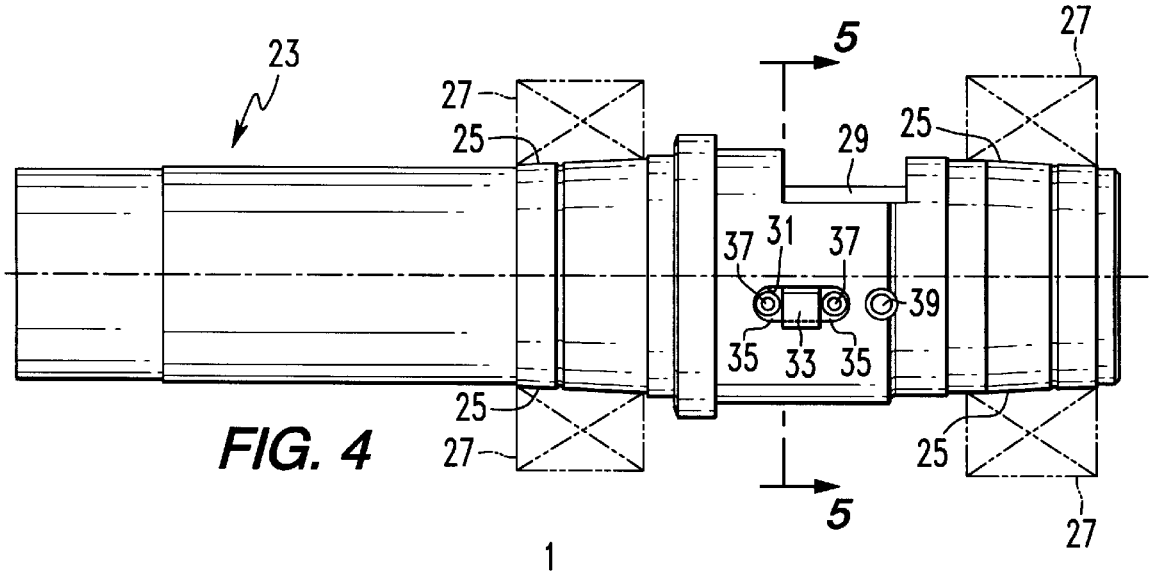
FIG. 4 is an elevation view of an arbor in accordance with the invention.
Figure 5:
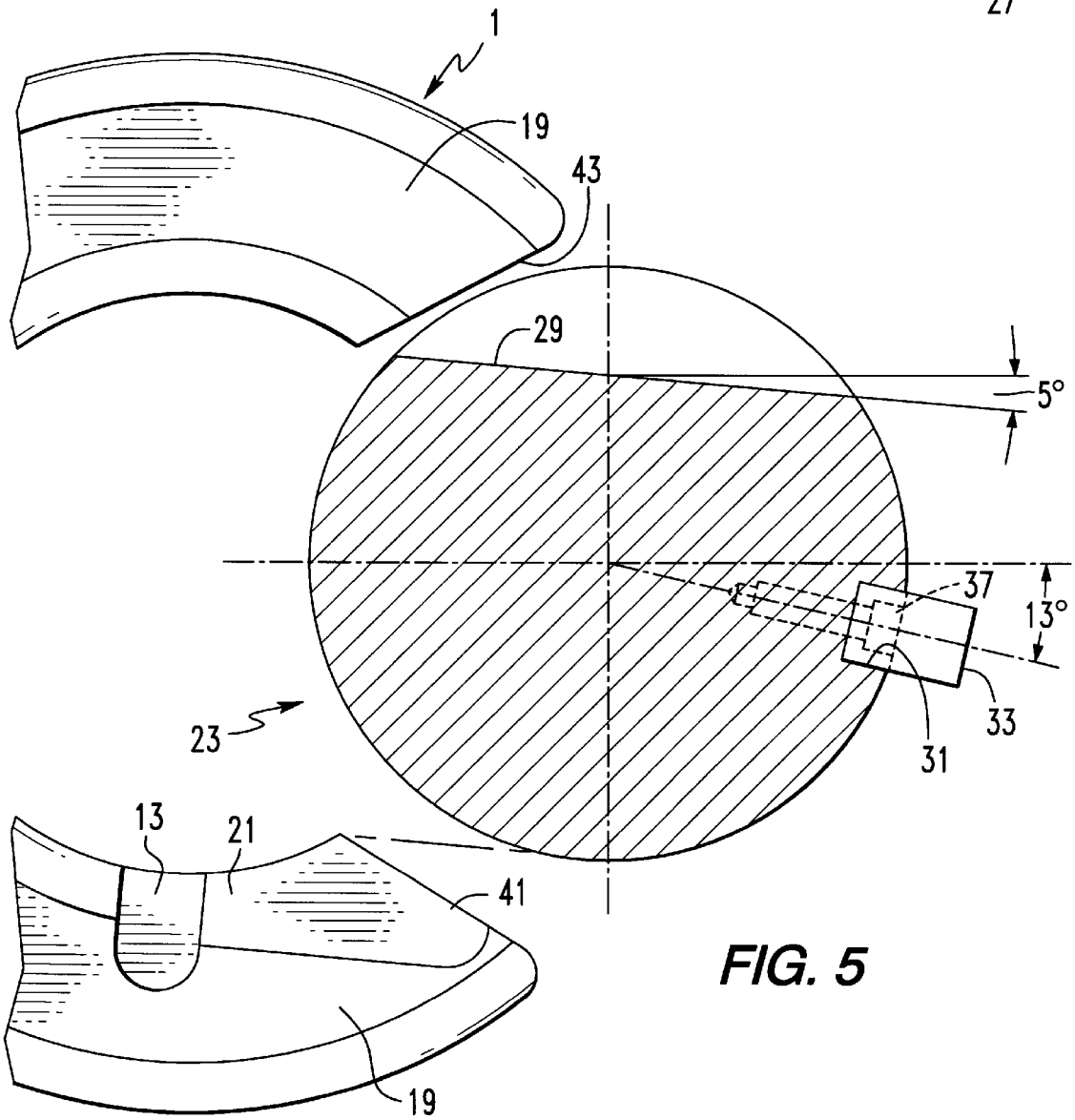
FIG. 5 is a section through the arbor taken along the line 5—5 in FIG. 4 and showing the die in position for mounting on the arbor.

Turning to FIGS. 4 and 5, the arbor 23 on which the pilger die 1 will be mounted is a cylindrical shaft having a number of axially spaced surfaces including the bearing surfaces 25 which are engaged by bearing shown schematically at 27 when the arbor is mounted in a pilger machine. The die 1 is mounted on the arbor between these bearing surfaces 25. In accordance with the invention, a section 29 of the arbor 23 has a reduced cross-sectional dimension which in the preferred embodiment of the invention is a flat surface extending across the arbor. Circumferentially spaced from the flat 29 and oriented longitudinally on the arbor is an oval keyway recess 31. A key 33 has a pair of semicircular ears 35 through which screws 37 extend to seat the key 33 in the keyway recess 31. Axially spaced from the key 33 is a removable stop screw 39 which extends above the surface of the arbor. Because in the exemplary arrangement the axial space available on the arbor between the bearing surfaces 25 is limited, it can be seen from FIG. 4 that the key 33 axially overlaps the flat 29.

Figure 6:
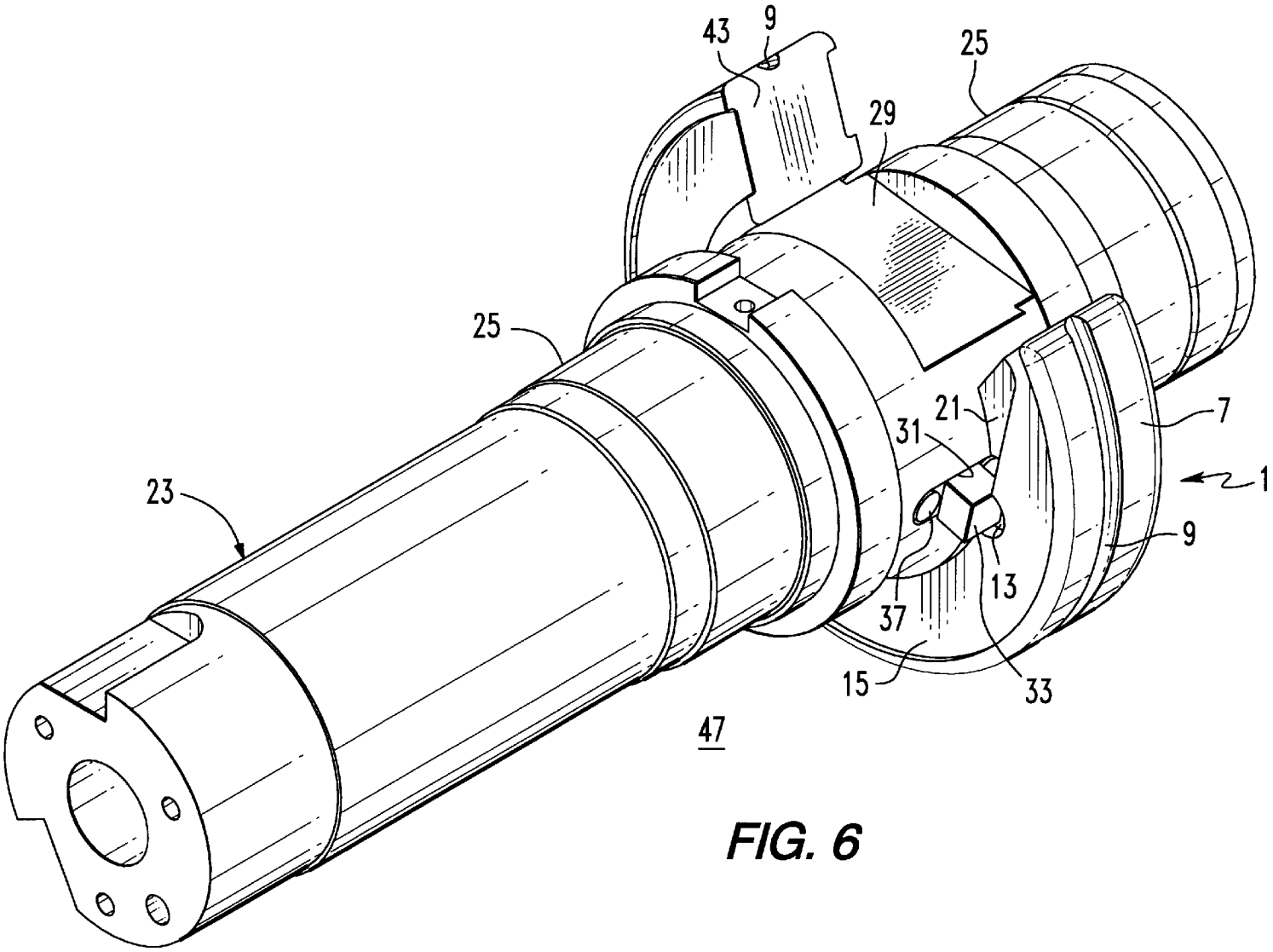
FIG. 6 is an isometric view of a pilger die assembly in accordance with the invention.

As can be visualized from FIGS. 5 and 6, the pilger die 1 is mounted on the arbor 23 by aligning the opening 11 with the flat 29 and sliding the die transversely until it is in coaxial registration with the arbor. The width of the opening $d_1$ (see FIG. 2) at the through bore 5 is selected so as to provide clearance at the widest dimension of the arbor at the flat 29. It can now be seen why the second circumferential angle $\alpha_2$ is preferably selected to be angularly smaller than the first circumferential angle $\alpha_1$ at the through bore 5, but the opening is made wider at the peripheral surface $d_2$ than at the through bore $d_1$. By having $d_2$ greater than $d_1$, the opening has a lead angle for guiding it onto the arbor. This could be done, for instance, by making the angle $\alpha_2$ equal to $\alpha_1$. However, there is also a need to provide sufficient peripheral surface 7 to accommodate the required length of the die groove 9. The latter of course could be maximized by making $d_2$ equal to $d_1$. However, this would not provide a lead angle which is useful in guiding the die onto the arbor. In the exemplary embodiment of the invention, the opening is 11 is defined by an angle $\alpha_3$ with the sides 41 and 43 of the opening 11 then made parallel to but offset by a distance x from the radials defining the angle $\alpha_3$. In the particular embodiment of the invention shown, the angle $\alpha_3$ is 60° and the distance x is 1", although other angles and offsets could be used.

Once the pilger die 1 is in coaxial registration with the arbor 23, it is moved to a captured position. By captured position it is meant that the die is rotated and/or moved axially so that the opening 11 is out of registration with the flat 29.

As previously discussed because of axial space limitations between the bearing surfaces 25 on the arbor, the key 33 axially overlaps the flat 29. However, the groove 21 in the first side face 15 of the die 1 provides clearance for rotation of the die on the arbor until the keyway 13 is aligned with the key 33. The die is then pushed axially onto the key 33 and the stop screw 37 is installed to prohibit the die from coming out of the keyway 13. Thus, it can be seen that the keyway 13 in the die 1, the key 33 on the arbor and stop screw 37 provide a locking arrangement 45 for securing the die in the captured position (see FIG. 6). The die 1 and the arbor 23 to which it is secured form the pilger die assembly 47.

Removal of the die 1 is as easy as its installation. The stop screw 39 is removed, the die is slid axially to disengage the keyway 13 from the key 33, then the die is rotated to align the opening 11 with the flat 29 on the arbor, so that, finally, the die is removed by drawing the opening 11 over the reduced diameter section of the arbor formed by the flat 29. Removal of the worn die and replacement with a new die in accordance with the invention only takes about 10 minutes compared with the more than three hours required for the conventional pilger die. An important part in saving of time is that the die can be changed without removal of the arbor from the pilger machine saddle and without the need for heating the dies.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A pilger die assembly comprising:

a die having an annular body with a central through bore, a peripheral surface with a circumferentially extending die groove therein, and an opening extending through said annular body from said through bore through said peripheral surface and subtending a first circumferential angle at said through bore of less than 180°; and a cylindrical arbor having a section with a reduced cross-sectional dimension sized to allow said die, through alignment of said opening with said section of reduced cross-sectional dimension, to pass into coaxial registration with said arbor, and to be moved on said arbor to a captured position with said opening in said die out of alignment with said section of reduced cross-sectional dimension of said arbor, and locking means retaining said die in said captured position on said arbor.

2. The assembly of claim 1 wherein said through bore in said annular body subtends a second circumferential angle at said peripheral surface which is angularly smaller than said first circumferential angle.

3. The assembly of claim 1 wherein said opening is wider circumferentially at said peripheral surface than at said through bore.

4. The assembly of claim 1 wherein said section of reduced cross-sectional dimension in said arbor comprises a flat extending across said section of said arbor.

5. The assembly of claim 1 wherein said locking means includes a keyway in one of said die and said arbor, and a key fixed to the other of said die in said arbor which is received in said keyway to prevent rotation of said die on said arbor.

6. The assembly of claim 5 wherein said die has a first side face and said keyway extends axially along said through bore from said first side face, and said key is fixed to said arbor.

7. The assembly of claim 6 wherein said die has a second side face opposite said first side face and wherein said locking means further includes a stop secured to said arbor and bearing against said second side face of said die with said keyway engaged with said key.

8. The assembly of claim 6 wherein said section of reduced cross-sectional dimension in said arbor comprises a flat extending across said section of said arbor and wherein said key to said arbor axially overlaps said flat and faces circumferentially away from said die as said die is passed over said flat, and said die has a recess in said first side face accommodating said key for rotation of said die on said arbor to align said keyway with said key for axial engagement of said keyway with said key.

9. A pilger die comprising: an annular body with a central through bore, a peripheral surface with a circumferentially extending die groove therein, and an opening extending through said annular body from said through bore through said peripheral surface and subtending a first circumferential angle at said through bore of less than 180°.

10. The pilger die of claim 9 wherein said opening in said annular body subtends a second circumferential angle at said peripheral surface which is angularly smaller than said first circumferential angle.

11. The pilger die of claim 9 wherein said annular body has a first side face and a keyway extending from said first side face and axially along said through bore.

12. The pilger die of claim 10 wherein said opening is circumferentially wider at said peripheral surface than at said through bore.

13. The pilger die of claim 11 wherein said annular body has a recess in said first face extending circumferentially from said opening to said keyway around said through bore.

14. The pilger die of claim 13 wherein said opening in said annular body subtends a second circumferential angle at said peripheral surface which is angularly smaller than said first circumferential angle.

15. The pilger die of claim 14 wherein said opening is circumferentially wider at said peripheral surface than at said through bore.

* * * * *